US007946524B1

(12) United States Patent
Meyers

(10) Patent No.: US 7,946,524 B1
(45) Date of Patent: May 24, 2011

(54) DEVICE FOR HOLDING THE FREE END OF A SPOOL-WOUND ITEM AT A POINT-OF-SALE DISPLAY

(76) Inventor: Kenneth B. Meyers, Ivyland, PA (US)

( * ) Notice: Subject to any disclaimer, the term of this patent is extended or adjusted under 35 U.S.C. 154(b) by 148 days.

(21) Appl. No.: 12/035,434

(22) Filed: Feb. 21, 2008

(51) Int. Cl.
*B65H 19/28* (2006.01)

(52) U.S. Cl. ..... 242/579; 242/125.2; 242/580; 242/586; 24/336; 24/563

(58) Field of Classification Search ..... 242/137, 242/579, 580, 586; 24/336, 563; 40/651, 40/666, 658
See application file for complete search history.

(56) References Cited

U.S. PATENT DOCUMENTS 1,409,100 A * 3/1922 Hamer ..... 40/658
1,867,276 A * 7/1932 Mcintyre ..... 248/231.71
3,150,769 A 9/1964 Cohn ..... 242/137
3,324,585 A * 6/1967 Frederickson ..... 40/658
3,780,209 A * 12/1973 Schuplin ..... 174/51
4,017,943 A * 4/1977 Moore ..... 248/251
4,541,586 A * 9/1985 Crowe ..... 242/129.5
5,704,479 A 1/1998 Barnett ..... 206/395
7,124,674 B2 * 10/2006 Maxey ..... 83/649

* cited by examiner

*Primary Examiner* — Sang Kim
(74) *Attorney, Agent, or Firm* — LaMorte & Associates

(57) ABSTRACT

A device and method for preventing a wound item from inadvertently unwinding from a spool in a point-of-sale display. The point-of-sale display includes a shelf that holds the spool. The shelf has a forward edge that prevents the spool from rolling off the shelf. A device is provided that holds the wound item as it is drawn away from the spool. The device inhibits the movement of the wound item so that the wound item will not unwind from the spool when not manually drawn from the spool. The device includes a clip body that selectively engages the forward edge of the shelf proximate the spool. A retention mechanism is coupled to the clip body, wherein the retention mechanism receives and retains a section of the wound item, thereby preventing said wound item from inadvertently unwinding.

19 Claims, 6 Drawing Sheets

DEVICE FOR HOLDING THE FREE END OF A SPOOL-WOUND ITEM AT A POINT-OF-SALE DISPLAY

BACKGROUND OF THE INVENTION

1. Field of the Invention

In general, the present invention relates to point-of-sale displays that hold cables, chains, rope and other spool wound items. More particularly, the present invention relates to devices used to confine spool wound items on a store shelf so that such items do not inadvertently unwind from the spool.

2. Prior Art Description

In many hardware stores, electronics stores and similar venues, items such as cable, wire, rope, and chains are sold to the public. Often such items come prepackaged in defined lengths. However, many stores offer such items for sale by the foot. When a flexible item, such as a cable or rope is sold by the foot, it is generally held on a large spool. The length of the item requested by a customer is unwound and cut from the spool as needed.

In many stores, such as in large national chain hardware stores, spool wound items are left available for the public to access unassisted. This enables a person to cut his/her own length of cable or rope from a spool. In such stores, the spools of materials are typically suspended around a central rod along an isle display. The spools are usually suspended around a central rod so that the spools are free to spin as a length of material is pulled from the spool. A problem associated with such displays is that the wound items tend to unwind from the spools. As an item unwinds from a spool, the free end of that item becomes hard to find. Furthermore, if enough of the item unwinds, the unwound coils may tangle.

In the prior art, stores have approached this problem in a variety of ways. Many stores now carry cable, wire and the like confined within a box. The free end of the cable or wire protrudes through a hole in the box. Such spool containment boxes are exemplified by U.S. Pat. No. 3,150,769 to Cohn, entitled Wire Packaging And Handling Device, and U.S. Pat. No. 5,704,479 to Barnett, entitled Wire Storing And Dispensing Package.

A problem associated with such spool containment boxes is that often the free end of the cable or wire retreats into the box and becomes inaccessible. Furthermore, customers cannot see into the box to determine how much material is left on the spool. A person may, therefore, begin to draw cable or wire from the spool only to find the remaining material is too short for the customer's needs.

Another approach to spool management in stores is to place spools of cable, wire, and rope on open shelves that are shaped to cradle the spools. The shape of the shelves retains the spools and holds the spools in place as material is drawn from the spools. Furthermore, the spools on the shelf are visible to the customer.

The problem with open shelves is that the free end of the cable or wire often flips to the back of the spool at the rear of the shelf. Furthermore, as cable or wire is drawn from a spool, more room becomes present between the shelf and the spool. This space provides room for the material to unwind and the loose coils become tangled.

A need therefore exists for a point-of-sale display for spool wound items, where the material on the spools is visible, easily accessed by customers, and actively prevented from inadvertently unwinding. This need is met by the present invention as described and claimed below.

SUMMARY OF THE INVENTION

The present invention is a device and method for preventing a wound item from inadvertently unwinding from a spool in a point-of-sale display. The point-of-sale display includes a shelf that holds the spool. The shelf has a forward edge that prevents the spool from rolling off the shelf.

A device is provided that holds the wound item as it is drawn away from the spool. The device inhibits the movement of the wound item so that the wound item will not unwind from the spool when not manually drawn from the spool. The device includes a clip body that selectively engages the forward edge of the shelf proximate the spool. A retention mechanism is coupled to the clip body, wherein the retention mechanism receives and retains a section of the wound item, thereby preventing said wound item from inadvertently unwinding.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention device is used in conjunction with a spool at a point-of-sale application. Although the spool can be used to hold different items, such as wire, rope, chains, strapping, ribbon and the like, in the illustrated embodiment, a metal cable is shown. The selection of a metal cable as the wound item on the spool is exemplary and was selected merely for its ease of illustration. Accordingly, it should be understood that in the following description, wire, rope, chair, strapping, ribbon and any other spool wound item can be substituted for the exemplary wire cable.

Figure 1:
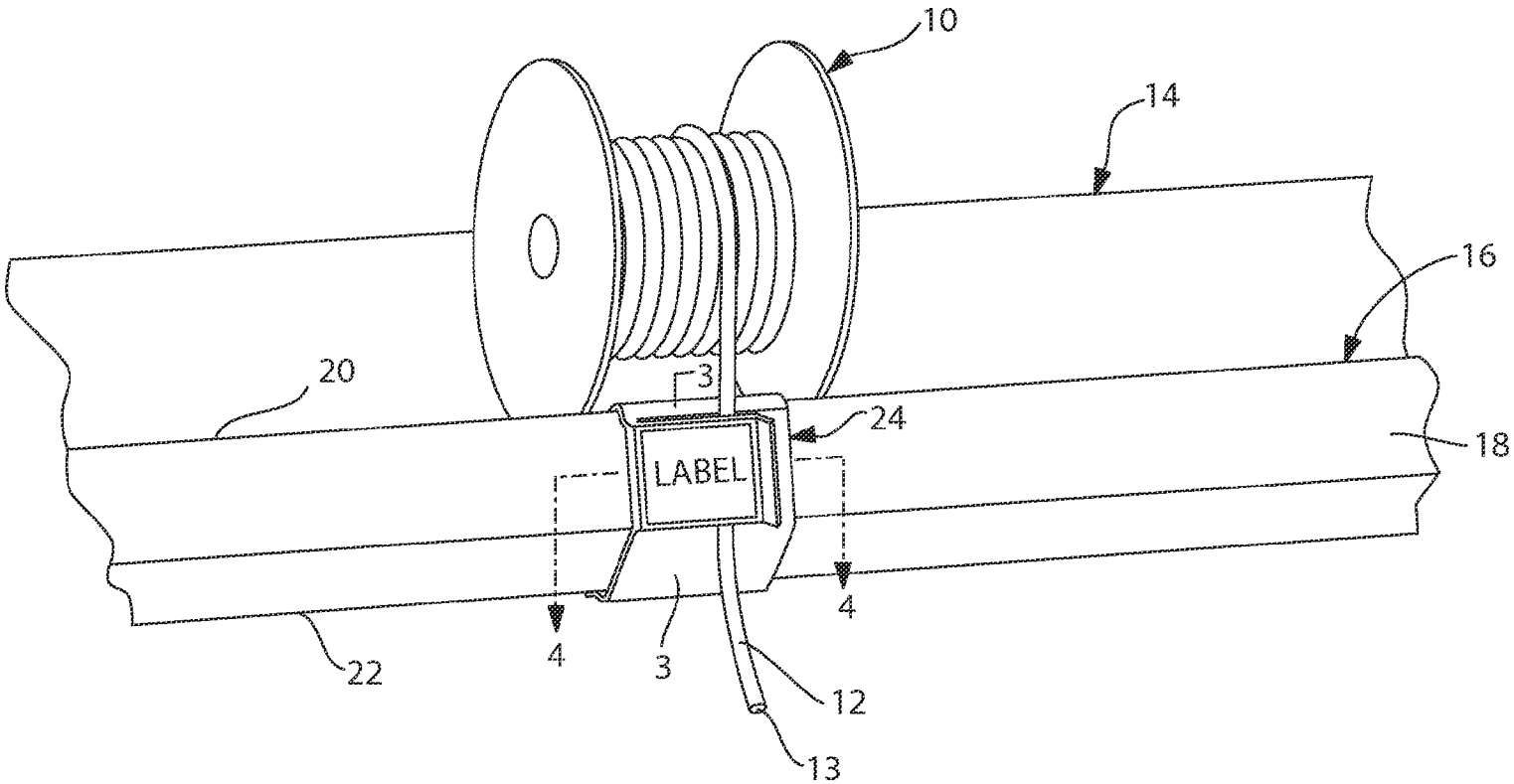
FIG. 1 is a perspective view of an exemplary embodiment of the present invention device shown in conjunction with a spool of a wound item and a shelf of a point-of-sale display.
Figure 2:
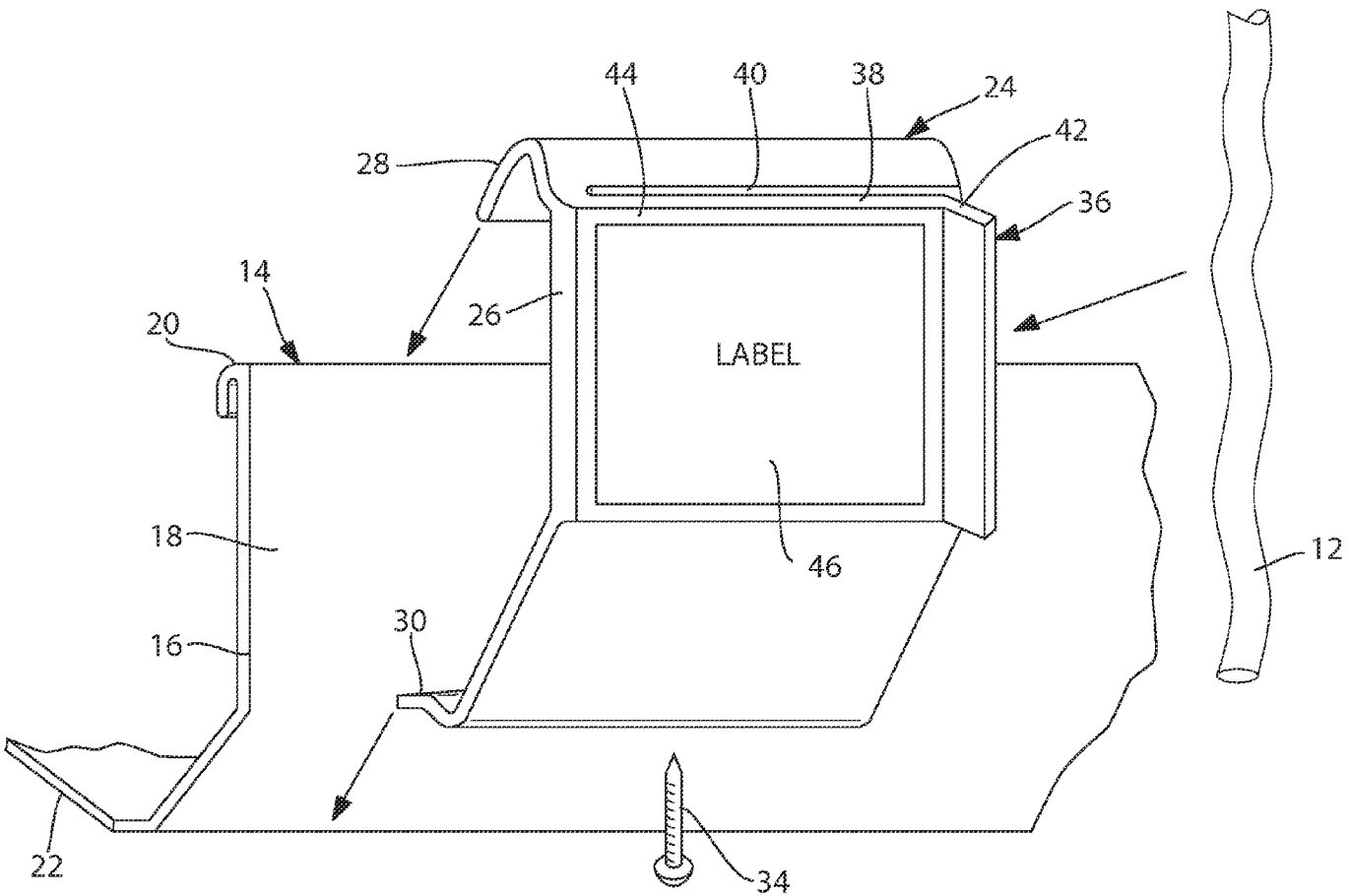
FIG. 2 is an enlarged exploded view of the embodiment of FIG. 1.

Referring to FIG. 1 and FIG. 2, a spool 10 of the exemplary wire cable 12 is shown. The wire cable 12 is wound around the spool 10 in a traditional manner and terminates with a free end 13. The spool 10 is seated upon a shelf 14 to create a point-of-sale display. The shelf 14 is configured to cradle the spool 10 and prevent the spool 10 from rolling out of place. As part of the cradling provided by the shelf, the shelf has a large forward edge 16. The forward edge 16 prevents the spool 10 from rolling forward off the shelf 14 as the wire cable 12 is drawn off the spool 10. The forward edge 16 of the shelf 14 has a contoured face 18 that extends from a top surface 20 to a bottom surface 22. The face 18 of the forward edge 16 is the surface of the shelf 14 most visible to a customer viewing the shelf 14. The shape of the contoured face 18 varies depending upon the manufacturer of the shelving.

A clip assembly 24 is provided. The clip assembly 24 attaches to the forward edge 16 of the shelf 14, over the contoured face 18. The clip assembly 24 receives and retains the free end 13 of the wire cable 12. In this manner, the free end 13 of the wire cable 12 cannot rotate to the back of the spool 10. Furthermore, since the free end 13 of the wire cable 12 is being held, the wire cable 12 cannot inadvertently unwind.

Figure 3:
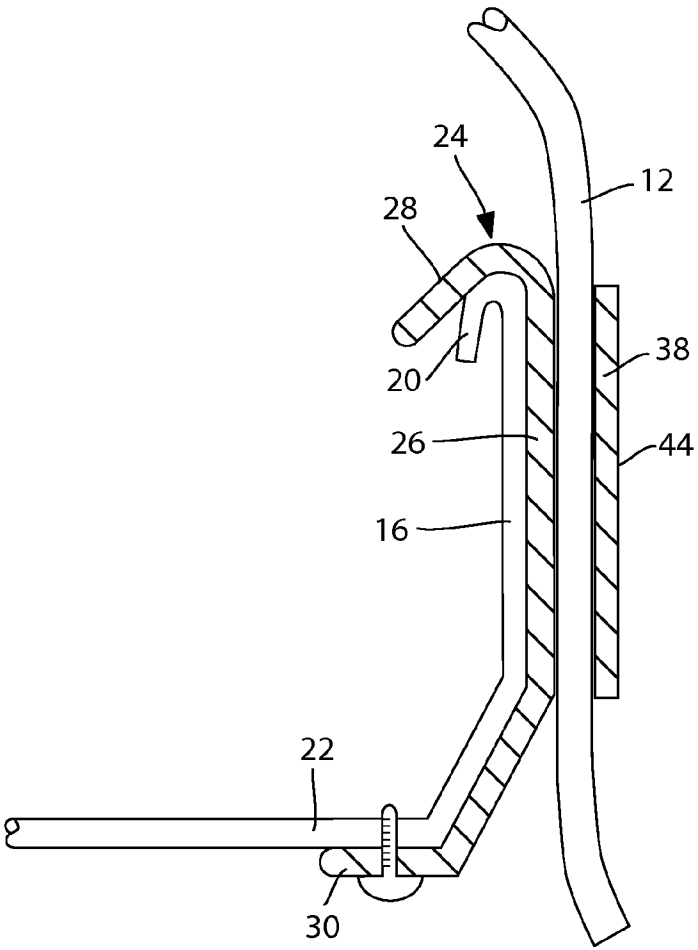
FIG. 3 is a cross-sectional view of the clip assembly in FIG. 1 viewed along section line 3-3.
Figure 4:
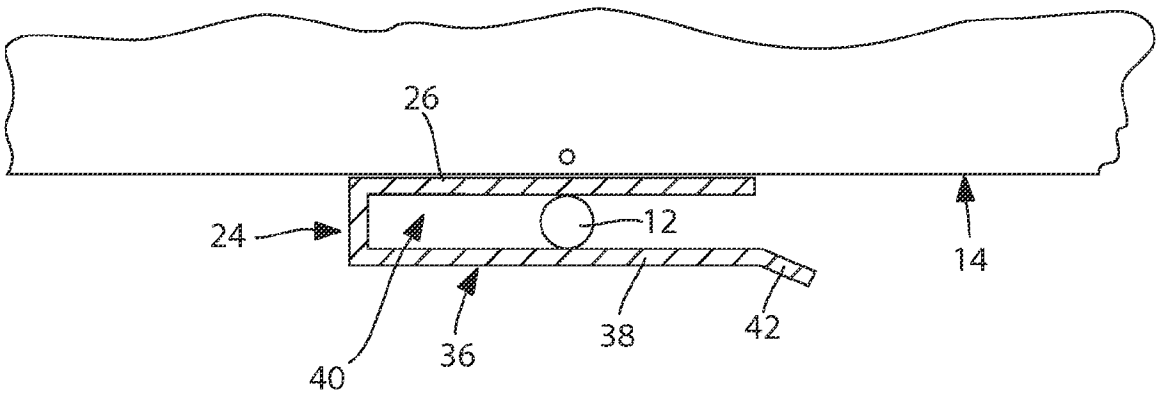
FIG. 4 is a cross-sectional view of the clip assembly in FIG. 1 viewed along section line 4-4.

Referring to FIG. 2 in conjunction with both FIG. 3 and FIG. 4, the structure of the clip assembly 24 can be described. The clip assembly 24 includes a main body 26. The main body 26 is configured to fit over the contoured face 18 of the shelf 14. A hooked ledge 28 extends rearwardly from the top of the main body 26. Conversely, a mounting ledge 30 extends rearwardly from the bottom of the main body 26. When the clip assembly 24 is placed against the contoured face 18 of the shelf 14, the hooked ledge 28 hooks around the top surface 20 of the forward edge 16. The mounting ledge 30 is positioned so that it passes over the bottom surface 22 of the forward edge 16. The mounting ledge 30 can be configured so that it engages the bottom surface 22 of the forward edge 16 with a slight interference fit. In this manner, friction retains the clip assembly 24 in engagement with the forward edge 16 of the shelf 14. However, in the shown embodiment, a hole 32 is formed in the mounting ledge 30. A screw or similar mechanical fastener 34 can then be used to lock the clip assembly 24 in place on the contoured face 18 of the shelf 14.

A retention mechanism 36 is coupled to the main body 26 of the clamp assembly 24. The retention mechanism 36 is a structure that receives and retains the free end 13 of a cable, wire, rope or any other spool wound item that may sit upon the shelf. The retention mechanism 36 can have many forms, as will later be explained. In the shown embodiment, the retention mechanism 36 is a cantilever arm 38. The cantilever arm 38 has one end that is anchored to the main body 26 of the clip assembly 24. The opposite end of the cantilever arm 38 extends out freely. A gap 40 exists between the cantilever arm 38 and the main body 26 that is slightly smaller than the thickness of the cable 12 wound on the spool 10. The free end of the cantilever arm 38 can have a flare 42 to facilitate the passage of a length of cable 12 into the gap 40 between the cantilever arm 38 and the main body 26 of the clip assembly 24.

To utilize the clip assembly 24, the clip assembly 24 is attached to the contoured face 18 of a shelf 14 below a spool 10. The cable 12 wound on the spool 10 is then manually manipulated into the gap 40 between the cantilever arm 38 and the main body 26 of the clip assembly 24. The cable 12 is wider than the gap 40. The cantilever arm 38 is therefore slightly displaced by the presence of the wire cable 12 and applies a compression bias to the wire cable 12. The wire cable 12 can be readily pulled down through the gap 40 of the clip assembly 24. However, when left alone, the wire cable 12 is pinched under the cantilever arm 38 with enough force to prevent the wire cable 12 from inadvertently rewinding back around the spool 10.

The cantilever arm 38 is wide in order to increase the friction applied to the wire cable 12. The wide cantilever arm 38, therefore, also provides a large display surface 44 that will face outwardly from the shelf 14. Printed indicia 46 in the form of a display sticker, information sticker, and/or pricing sticker can be applied to the display surface 44. In this manner, no stickers have to be applied to the actual shelving. If a sticker requires changing, the sticker can be peeled away and replaced. If it is not possible to remove the old sticker, the entire clip assembly 24 can be replaced with no damage to the shelf 14.

Figure 5:
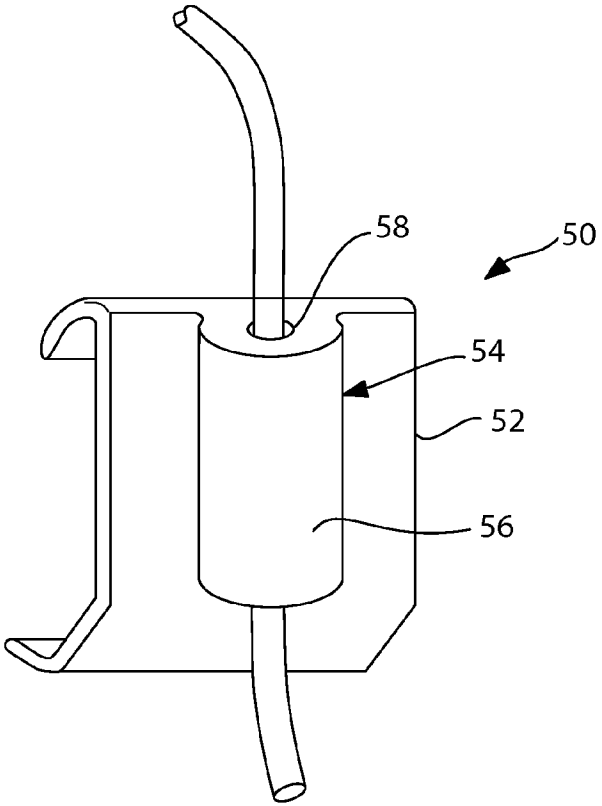
FIG. 5 is perspective view of an alternate embodiment of the present invention.

Referring to FIG. 5, an alternate embodiment of a clip assembly 50 is shown. In this embodiment, a clip assembly 50 is shown having a main body 52 similar to that previously described. However, in this embodiment, the retention mechanism 54 is an annular magnet 56. The annular magnet 56 is anchored to the main body 52. The annular magnet 56 defines a vertical hole 58. The cable 12 passes through the annular magnet 56. The cable 12 is drawn to the inside of the annular magnet 56 by the magnetic field created by the annular magnet 56. The magnetic attraction between the cable 12 and the annular magnet 56 holds the cable in place within the clip assembly 50. However, the cable 12 is still free to be pulled straight through the annular magnet 56 for dispensing purposes.

It will be understood that the use of an annular magnet 56 as a retention mechanism 54 only works for metal cables, chains and other ferro-magnetic spool wound items. Non-magnetic spool wound items, such as rope, can use the retention mechanism of FIG. 2 or a retention mechanism of the type described below.

Figure 6:
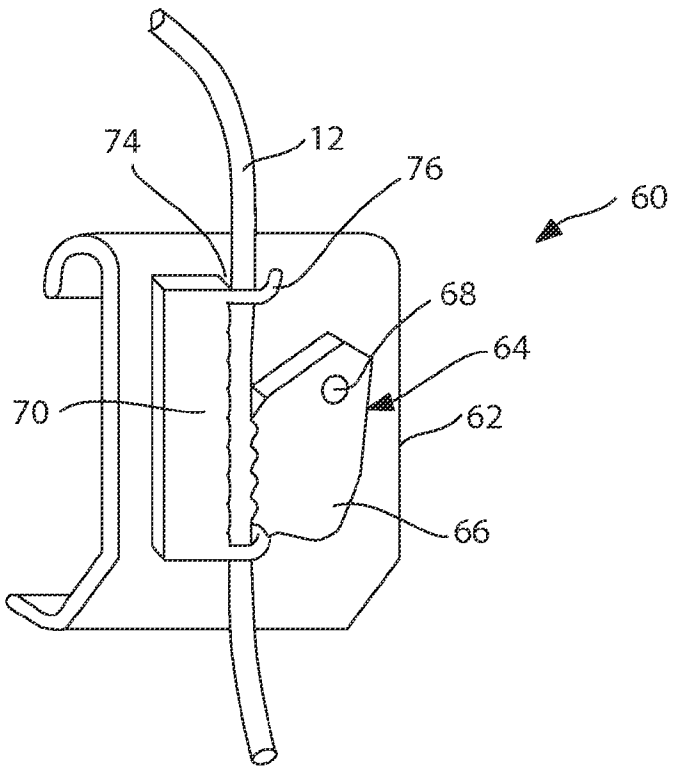
FIG. 6 is perspective view of a second alternate embodiment of the present invention.

Referring to FIG. 6, another alternate embodiment of a clip assembly 60 is shown. In this embodiment, the clip assembly 60 again has a main body 62 that attaches to a shelf in a traditional manner. The cable retention mechanism 64 is a mechanical rope clamp. The retention mechanism 64 includes a cam 66 that is attached to the main body 62 at a pivot 68. The cam 66 is biased toward a wall 70 by a torsion spring 72 that is disposed around the pivot 68. A cable 12 is passed into a gap 74 between the cam 66 and the wall 70. A guide ring 76 prevents the cable 12 from pulling out of the gap 74. The cam 66 enables the cable 12 to be pulled off the spool but prevents the cable 12 from rewinding back onto the spool.

It will be understood that the embodiments illustrated for the present invention clip assembly are merely exemplary and that a person skilled in the art can vary those embodiments using functionally equivalent components. For instance, it will be understood that the shape of the main body of the clip assembly can be altered to fit different shelves from different manufacturers. Furthermore, the few embodiments of cable retention mechanisms illustrated represent only some of the mechanisms that can be used to receive and retain the free end of a cable. All such variations, modifications, and alternate embodiments are intended to be included within the scope of the present invention as defined by the claims.

What is claimed is:

1. In a point-of-sale display of spool wound items, wherein said display contains at least one shelf for holding a spool of a spool wound item and wherein said shelf has a forward edge that prevents said spool from rolling off said shelf, a device for preventing said spool wound item from inadvertently unwinding from said spool, said device comprising:

a clip body that selectively engages said forward edge of said shelf proximate said spool; and a retention mechanism coupled to said clip body, wherein said retention mechanism receives and retains a section of said spool wound item, therein retaining said section of said spool wound item in a vertical orientation while preventing said spool wound item from inadvertently unwinding from said spool.

2. The display according to claim 1, wherein said retention mechanism enables the spool wound item to drawn down vertically through said retention mechanism while being retained by said retention mechanism.

3. The device according to claim 2, wherein said retention mechanism enables said spool wound item to pass in only one direction through said retention mechanism.

4. The device according to claim 1, wherein said retention mechanism includes an arm, wherein a gap exists between said clip body and said arm, and wherein said gap is sized to pinch said spool wound item should said spool wound item be passed through said gap.

5. The device according to claim 4, wherein said arm is cantilevered and said gap is open at a first end of said arm.

6. The device according to claim 5, wherein said arm is flared proximate said first end.

7. The device according to claim 1, wherein said retention mechanism includes a magnet.

8. The device according to claim 7, wherein said retention mechanism includes an annular magnet that defines a hole through which said spool wound item can pass.

9. The device according to claim 1, wherein said retention mechanism includes a rope clamp.

10. A point-of-sale assembly for a spool of a wound item, said assembly comprising:

a shelf having a forward edge;

a retention mechanism coupled to said forward edge of said shelf; and a spool of a wound item supported by said shelf, wherein said wound item has a free section that is unwound from said spool and is received and engaged by said retention mechanism, wherein said retention mechanism retains a portion of said free section in a vertical orientation and inhibits said free section from further unwinding from said spool.

11. The assembly according to claim 10, wherein said retention mechanism is selectively adjustable in position along said forward edge of said shelf.

12. The assembly according to claim 11, wherein said retention mechanism includes a clip for selectively engaging said forward edge of said shelf.

13. The assembly according to claim 10, wherein said retention mechanism includes an arm, wherein a gap exists under said arm through which said free section of said wound item passes.

14. The assembly according to claim 13, wherein said free section of said wound item is thicker than said gap and slightly displaces said arm when present in said gap, therein causing said arm to apply a pinching bias to said wound item.

15. The device according to claim 13, wherein said arm is cantilevered and said gap is open at a first end of said arm.

16. The device according to claim 15, wherein said arm is flared proximate said first end.

17. The device according to claim 15, wherein said retention mechanism includes a magnet, and said wound item contains a magnetic metal.

18. A method of displaying a spool of wound material for sale in a store, said method comprising the steps of:

providing a shelf having a forward edge;

placing a spool of wound material on said shelf;

providing a retention mechanism to said forward edge of said shelf proximate said spool; and unwinding a free section of said wound material from said spool and advancing said portion through said retention mechanism, wherein said retention mechanism retains a portion of said free section in a vertical orientation and inhibits movement of said portion so that said wound material does not inadvertently unwind from said spool.

19. The method according to claim 18, wherein said step of providing a retention mechanism includes attaching a removable retention mechanism to said forward edge of said shelf.

* * * * *